US011021292B2

(12) United States Patent
Breisinger et al.

(10) Patent No.: US 11,021,292 B2
(45) Date of Patent: Jun. 1, 2021

(54) CONTAINER COMPRISING A THERMOFORMED TUB AND DOSING UNITS LOCATED THEREIN

(71) Applicant: Henkel AG & Co. KGaA, Duesseldorf (DE)

(72) Inventors: Julia Breisinger, Duesseldorf (DE); Frank Meier, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 88 days.

(21) Appl. No.: 15/922,294

(22) Filed: Mar. 15, 2018

(65) Prior Publication Data

US 2018/0273234 A1 Sep. 27, 2018

(30) Foreign Application Priority Data

Mar. 24, 2017 (DE) ..... 102017205050.0

(51) Int. Cl.
*B65D 1/40* (2006.01)
*B65D 57/00* (2006.01)
(Continued)

(52) U.S. Cl.
CPC ..... *B65D 1/40* (2013.01); *B65D 1/26* (2013.01); *B65D 1/44* (2013.01); *B65D 25/107* (2013.01); *B65D 57/00* (2013.01); *B65D 81/05* (2013.01); *B65D 85/50* (2013.01); *C11D 17/04* (2013.01); *C11D 17/042* (2013.01); *B65D 85/8046* (2013.01); *B65D 2543/00435* (2013.01)

(58) Field of Classification Search
CPC ... B65D 1/40; B65D 1/26; B65D 1/44; B65D 25/107; B65D 57/00; B65D 81/05; B65D 85/50; B65D 85/8046; B65D 2543/00435; B65D 65/46; C11D 17/04; C11D 17/042
USPC ..... 220/669
See application file for complete search history.

(56) References Cited

U.S. PATENT DOCUMENTS 3,987,829 A * 10/1976 Leone ..... B65D 1/22 220/796
4,473,165 A * 9/1984 Lentjes ..... B65D 21/0222 220/659
(Continued)

FOREIGN PATENT DOCUMENTS

DE 19729326 A1 1/1999
DE 20023801 U1 6/2006
(Continued)

OTHER PUBLICATIONS

European Search Report EP 18159629 Completed Aug. 15, 2018; dated Aug. 23, 2018 5 pages.

*Primary Examiner* — Andrew D Perreault
(74) *Attorney, Agent, or Firm* — Thomas G. Krivulka

(57) ABSTRACT

A container including a thermoformed tub made of a plastics material and including at least one dosing unit located in the tub interior, which dosing unit includes at least one active ingredient and a water-soluble casing for the active ingredient, the tub having a base and a tub wall that extends from the base. The tub wall has a plurality of projections that are oriented from a datum plane of the tub wall towards the tub interior, a distance between adjacent projections being less than a length and less than a width of the dosing unit. Preferably, the projections have a plurality of parallel ridges.

11 Claims, 6 Drawing Sheets

(51) Int. Cl.

| | |
|---|---|
| ***B65D 85/50*** | (2006.01) |
| ***B65D 1/44*** | (2006.01) |
| ***B65D 81/05*** | (2006.01) |
| ***C11D 17/04*** | (2006.01) |
| ***B65D 25/10*** | (2006.01) |
| ***B65D 1/26*** | (2006.01) |
| *B65D 85/804* | (2006.01) |

(56) References Cited

U.S. PATENT DOCUMENTS

| | | | | |
|---|---|---|---|---|
| D580,170 | S * | 11/2008 | Klotzman | D3/272 |
| 8,309,203 | B2 * | 11/2012 | Catalfamo | B65D 65/46 264/271.1 |
| 9,718,589 | B2 * | 8/2017 | Kopulos | B65D 21/0219 |
| 10,501,239 | B2 * | 12/2019 | Dagnelie | B65D 43/22 |
| 2008/0008859 | A1 | 1/2008 | Catalfamo | |
| 2011/0127271 | A1 | 6/2011 | Jaworski et al. | |
| 2011/0204087 | A1 * | 8/2011 | Kopulos | B65D 21/0219 220/810 |
| 2013/0206784 | A1 * | 8/2013 | Short | B65D 25/2811 220/760 |
| 2018/0134454 | A1 * | 5/2018 | De Wilde | B65D 43/22 |

FOREIGN PATENT DOCUMENTS

| | | | |
|---|---|---|---|
| DE | 102014206093 | A1 | 3/2014 |
| EP | 0049430 | A1 | 4/1982 |
| EP | 0479404 | A2 | 8/1992 |
| NL | 1012752 | C1 | 9/2000 |

* cited by examiner

CONTAINER COMPRISING A THERMOFORMED TUB AND DOSING UNITS LOCATED THEREIN

FIELD OF THE INVENTION

The invention relates to a container comprising a thermoformed tub made of a plastics material and comprising at least one dosing unit located in a tub interior, which dosing unit comprises at least one active ingredient and a water-soluble casing for the active ingredient.

BACKGROUND OF THE INVENTION

It is nowadays conventional to provide active ingredients from the group consisting of laundry detergents, dishwasher detergents, pharmaceuticals, bodycare products, etc., in flowable or pourable form in pre-dosed units (dosing units) which are stored in plastics containers and offered on the market as such. Simple and cost-effective production of the plastics container consists in shaping a tub, which is open at the top, by means of thermoforming a plastics material sheet or a film, which tub is then closed by a separately produced lid.

Handling the dosing units is relatively easy and convenient for the user. This will be illustrated using the example of a detergent as the active ingredient. The user purchases a container filled with detergent dosing units. After opening the cover, the user takes a detergent dosing unit from the tub and puts it in the drum or in a detergent drawer of a washing machine. The water-soluble casing ensures that the user does not come into contact with the detergent, which makes dealing with the detergent safer and easier. Because the detergent is pre-dosed, the user does not have to dose the detergent themselves as well. This also makes dealing with the detergent easier.

High air humidity can result in the water-soluble casing of the dosing unit becoming somewhat sticky even when the tub is closed, and said casing can adhere to the base of the tub or to a wall of the tub extending from the base. This not only impedes easy handling of the detergent, but also carries the risk of the wrapping being damaged when the dosing unit is taken out. This in turn can lead to detergent leaking out of the dosing unit and lead to corresponding inconvenience.

BRIEF SUMMARY OF THE INVENTION

The object of the invention is therefore to provide a container, comprising at least one dosing unit filled with an active ingredient, that can be produced in a cost-effective manner and that allows easy and safe handling of the active ingredient inside the dosing unit.

According to the invention, the tub wall comprises a plurality of projections that are oriented from a datum plane of the tub wall towards the tub interior, a distance between adjacent projections being less than a length and less than a width of the dosing unit. The projections provide the tub wall with a surface structure on account of which an effective contact surface of the dosing unit on the tub wall is reduced. This reduction of the contact surface means that detrimental sticking or adhering of the dosing unit to the tub wall is prevented or at least reduced. Because the distance between adjacent projections is small in relation to the dimensions of the dosing unit, it is possible for full-surface contact of the dosing unit with the tub wall to be virtually eliminated. Even if the water-soluble casing has a certain degree of stickiness, the dosing unit can be more easily removed from the tub on account of the smaller contact surface between the tub wall and the wrapping.

The length of the dosing unit is intended to be the largest extension of the dosing unit in one of the three spatial directions. The width is intended to be the second largest extension. A height of the dosing unit is intended to be the smallest of the three spatial extensions. In one embodiment, the distance between adjacent projections is also less than the height of the dosing unit, i.e. less than the smallest of the three extensions in the x, y or z direction.

The distance between adjacent projections may be less than half of the length and less than half of the width of the dosing unit. As a result, it can be ensured that when the dosing unit is accordingly located in the tub (for example the longest edge of the dosing unit abuts the tub wall), the dosing unit abuts at least two projections. Depending on the distance from and orientation with respect to the tub wall, the dosing unit may even abut three, four or even 15 projections at the same time.

In one embodiment, the projections comprise a first ridge that extends in a longitudinal direction and additional ridges that are parallel to the first ridge. Preferably, the design of the additional ridges corresponds to the design of the first ridge. Accordingly, in this embodiment, the tub wall comprises ridges of identical design. The following description of the design of the first ridge may therefore apply correspondingly to the additional ridges.

A width of the first ridge may be less than a distance between adjacent ridges. For example, the width of the first ridge may be from 5 to 25 mm. In a preferred embodiment, the width of the first ridge is 10 mm. The distance between two adjacent ridges may be from 5 to 30 mm, said distance being 13 mm in one embodiment.

The first ridge may extend from the base towards an upper tub edge. The first ridge thus extends vertically when the base of the tub lies on a horizontal storage surface. The first ridge may extend substantially over the entire distance between the base and the upper tub edge. A ridge-free region may be formed in the immediate vicinity of the base and/or in the immediate vicinity of the upper tub edge. This region may have a vertical height of from 5 to 15 mm. Preferably, the vertical height of this region is less than the length and less than the width of the dosing unit.

In one embodiment, a height of the first ridge varies in the longitudinal direction. For example, the height of the first ridge may increase constantly, preferably linearly, from the base towards the upper tub edge. Starting from the base, the first ridge may thus begin at a height equal to 0 mm and end at a height of from 0.5 to 10 mm in the vicinity of the upper tub edge. In one embodiment, the first ridge ends in the vicinity of the upper tub edge at a height of from 1 to 3 mm.

It is also possible for the height of the first ridge to be constant in the longitudinal direction. In this embodiment, too, the height of the ridge may be from 0.5 to 10 mm or preferably from 1 to 3 mm.

In principle, the first ridge may have any desired ridge contour in cross section. In one embodiment, in cross section, the first ridge has a first ridge slope, a ridge summit and a second ridge slope, the first ridge slope and the second ridge slope bridging a gap between the ridge summit and the datum plane of the tub wall. The ridge summit is thus spaced apart from the datum plane of the tub wall, the distance between the datum plane and the ridge summit corresponding to the height of the ridge. The ridge summit thereby substantially forms the contact surface for the at least one dosing unit, which is located in the tub interior.

The first ridge slope and the second ridge slope may extend obliquely with respect to one another and form an angle of from 60 to 120°. In one embodiment, the angle is from 80 to 100°.

The tub wall may comprise a front wall, a rear wall, a first side wall and a second side wall, the front wall, the rear wall, the first side wall and the second side wall each comprising projections. As a result, it can be ensured that the tub wall comprises no (larger) regions that could lead to full-surface contact of the potentially sticky wrapping of the dosing unit with the tub wall.

A surface area of the base of the tub may be smaller than a surface area of a tub opening. In the embodiment comprising the front wall, rear wall, first side wall and second side wall, at least two opposing walls may diverge from the base towards the tub opening.

In cross section, the tub may have a substantially rectangular basic shape. The corners between two adjoining walls may be rounded. In one embodiment, the front wall is curved slightly outwards, while the rear wall and the two side walls are straight.

In order to close the tub, the container may comprise a lid having a frame that sits securely on the tub and having a flap that is pivotally fastened to the frame. In a closed position, the flap may be latched to the frame by latching means which are preferably designed to be childproof. Unintended opening of the container can therefore be prevented.

The water-soluble wrapping may be made of a water-soluble polymer such as polyvinyl alcohol. The dosing unit may comprise at least one second active ingredient, the wrapping in this case forming not only one chamber, but rather two separate chambers. The active ingredients may differ in terms of chemical composition, color and/or presentation form (liquid, solid, particle size). For example, a two-chamber dosing unit is possible in which one active ingredient is liquid and the other active ingredient is in particle form.

BRIEF DESCRIPTION OF THE DRAWINGS

The invention is described in more detail with reference to the embodiments shown in the drawings, in which.

DETAILED DESCRIPTION OF THE INVENTION

Figure 1:
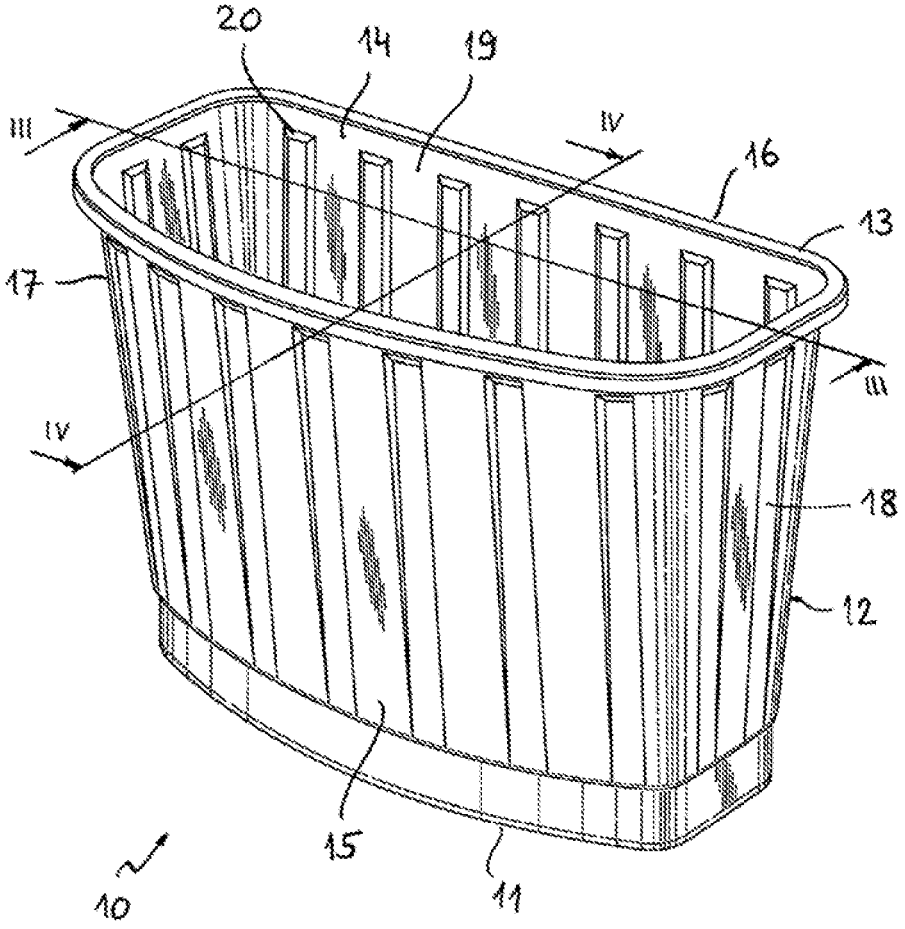
FIG. 1 is a perspective view of a tub of a container according to the invention.

FIG. 1 is a perspective view of a thermoformed tub 10 made of plastics material. The tub 10 comprises a base 11 and a circumferential tub wall 12, which extends from the base 11 to an upper tub edge 13. The circumferential tub wall 13 delimits a tub opening 14. The tub opening 14 can be closed by means of a lid (not shown).

The tub wall 11 comprises a front wall 15, a rear wall 16, a first side wall 17 and a second side wall 18. Sectional views of the tub 10 shown in FIG. 1 are given in FIG. 3 to 5.

The base 11 and the tub wall 12 delimit a tub interior 19, which receives a plurality of dosing units. The dosing units are not shown in FIG. 1, but are shown in FIG. 2 to 6, where they are provided with the reference sign 50.

The tub wall 12 comprises a plurality of ribs 20 which are arranged in parallel with one another and extend from the base 11 towards the upper tub edge 13. The ridges 20 are each of identical design.

Figure 2:
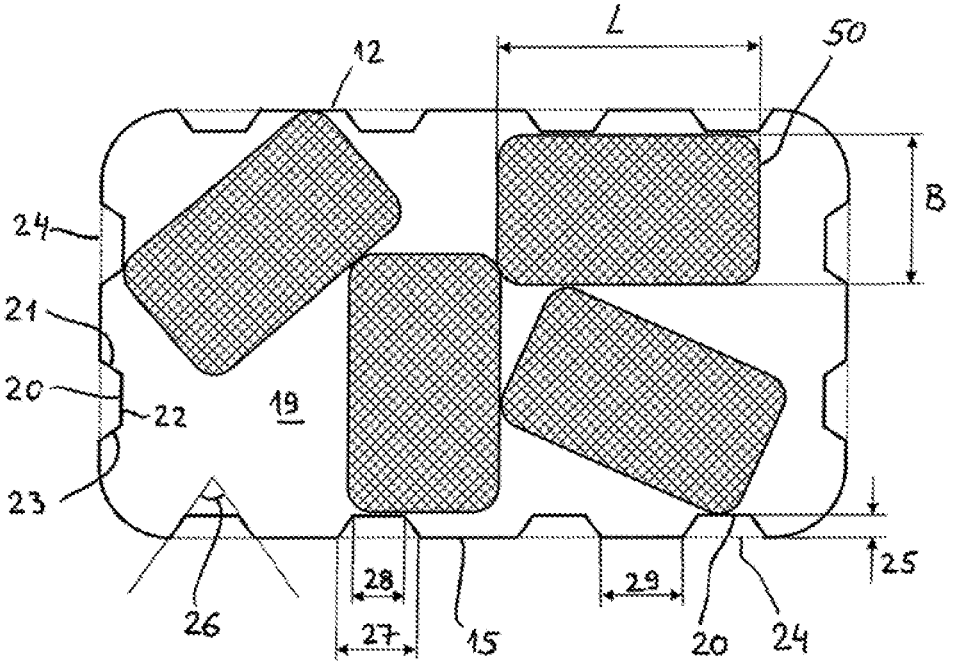
FIG. 2 is a highly schematic cross section of the tub.

FIG. 2 shows a cross section through the tub 10; however, it should be noted that FIG. 2 is merely a schematic representation of the tub 10 from FIG. 1. On account of the schematic portrayal, there are differences from the specific embodiment according to FIG. 1 (for example with regard to the number of ridges 20, the shape of the ridges, the design of the individual walls 15, 16, 17, 18).

Each of the ridges 20 comprises a first ridge slope 21, a ridge summit 22 and a second ridge slope 23, the ridges 20 all being oriented towards the tub interior 19. The ridge slopes 21, 23 bridge a gap between a datum plane 24 of the tub wall 12. In FIG. 2, this datum plane 24 is shown by a dotted line. The distance between the datum plane 24 and the ridge summit 22 corresponds to a height 25. Because the ridge slopes 21, 23 converge obliquely starting from the datum plane 24, which is illustrated in FIG. 2 by an angle 26, a width 27 of the first ridge 20 (measured in the datum plane 24) is greater than a width 28 of the ridge summit 22. In the schematic view in FIG. 2, a distance 29 between two adjacent ridges is approximately the same as the width 27 of the ridge 20.

Figure 6A:
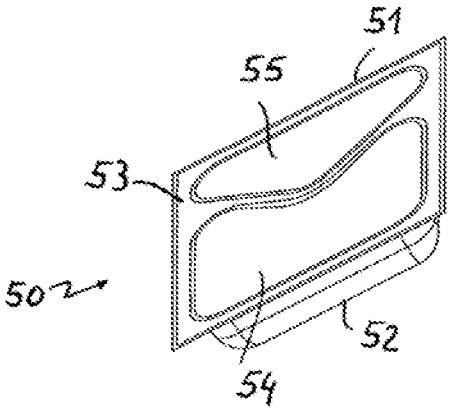
FIGS. 6A-6B consist of two perspective views of a dosing unit.
Figure 6B:
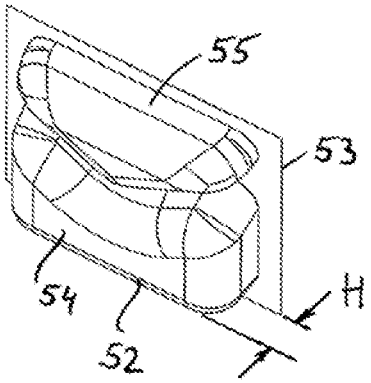

FIG. 2 schematically shows four dosing units 50 in the tub interior 19, each having a length L and a width B. A specific embodiment of said dosing unit 50 can be seen in FIG. 6 (see FIG. 6A, 6B). Furthermore, a height H of the dosing unit 50 is indicated in FIG. 6B. In the specific embodiment of the dosing unit in FIG. 6, the length L is intended to be 67 mm, the width B is intended to be 60 mm and the height H is intended to be 13 mm.

As can be seen in FIG. 2, the ridges 20 that are oriented towards the tub interior 19 prevent full-surface contact of the dosing units 50 with the tub wall 12. The dosing unit 50 rests against the ridges 20, in particular on the ridge summits 22 thereof, or against the tub wall 12 in the region of the datum plane 24. However, on account of the ridges 20 and the associated surface structuring, the effective contact surface between the tub wall 12 and the dosing units 50 is greatly reduced compared to a tub wall having no ridges. On account of the reduced contact surface, the risk of the dosing units 50 adhering to the tub wall 12 is greatly reduced, as is the risk of problems occurring when removing the dosing units from the tub 10. In the view in FIG. 2, the four dosing units 50 lie in a plane. In practice, the dosing units 50 may be arranged in the tub interior 19 in an entirely random manner.

The dosing unit 50 from FIG. 6 comprises a water-soluble wrapping 51 made of polyvinyl alcohol. The wrapping 51 is composed of a thermoform film 52 and a cover film 53. When thermoforming the thermoform film 52 into a thermoforming mold, a first pocket 54 and a second pocket 55 are formed. Said pockets 54, 55 receive a first active ingredient and a second active ingredient, respectively, for example in the form of a detergent and a detergent additive. After the active ingredients have been poured in, the cover film 53 is placed onto the open side of the pockets 54, 55 and seals the thermoformed thermoform film 52 such that two separate, closed chambers for active ingredients are produced.

Figure 3:
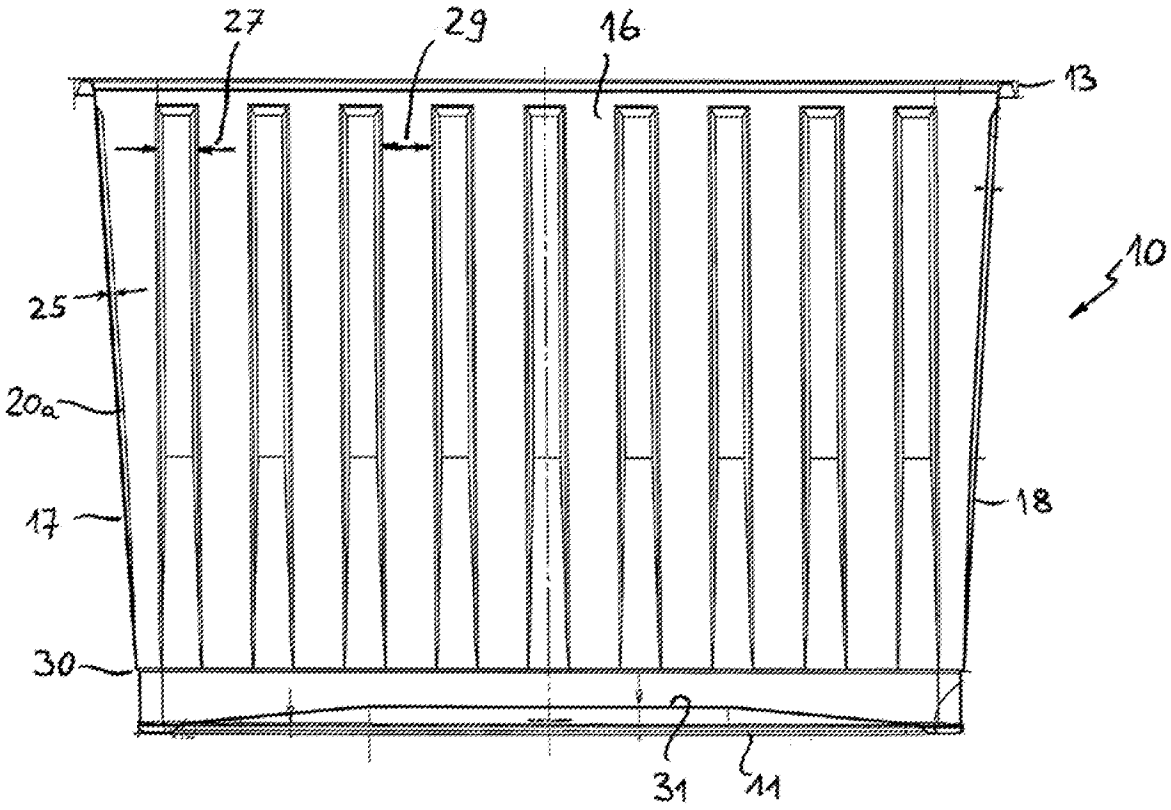
FIG. 3 is a section through another embodiment corresponding to the section along the line III-III in FIG. 1.

As can be seen in FIG. 3, nine ridges 20 are provided on the rear wall 16. It should be noted that the embodiment in FIG. 3 to 5 differs slightly from the embodiment in FIG. 1. The embodiment from FIG. 1, for example, thus comprises only seven ridges 20 on the rear wall 16. The longitudinal profile of each ridge 20 is rendered clear by the ridge 20*a* on the first side wall 17 (in this case the left-hand side wall). The height 25 of the ridge 20 increases with increasing distance from the base 11. The ridge 20*a* begins at a ledge 30 close to the base and starts at a height of 0 mm (height indicated by 25). Said height 25 increases with increasing distance from the ledge 30 in a linear manner and reaches its maximum value immediately below the upper tub edge 13, where the ridge 20*a* terminates. The height 25 in the vicinity of the upper tub edge 13 is, for example, from 12 to 1.8 mm. The width 27 should in this case be from 9 to 11 mm. The gap 29 should be from 12 to 14 mm. The volume of the tub 10 may for example be from 1000 to 5000 ml, preferably from 2000 to 4000 ml.

Figure 4:
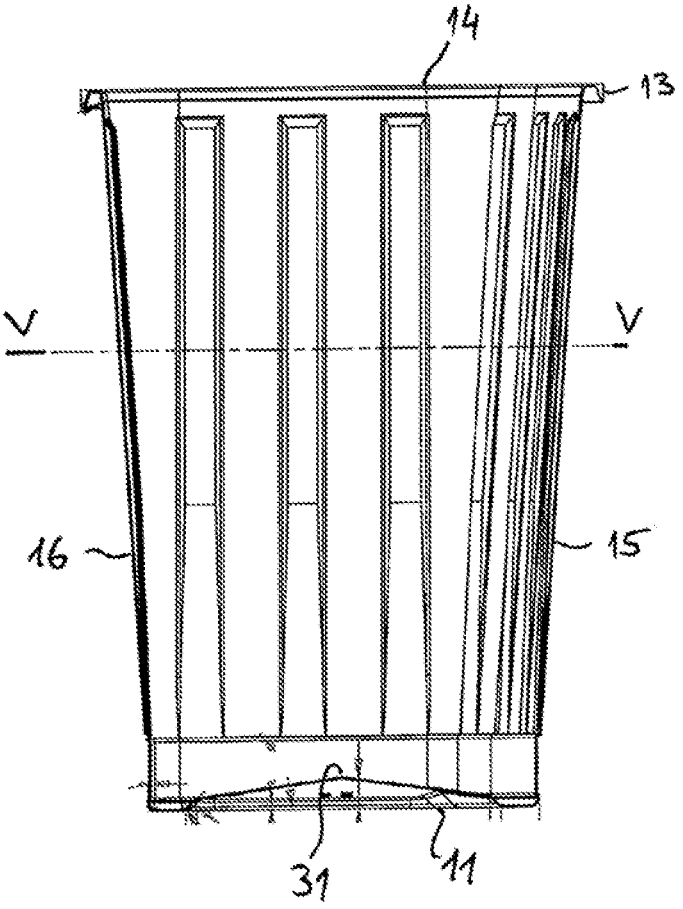
FIG. 4 is a section through the embodiment from FIG. 3 corresponding to the section along the line IV-IV in FIG. 1.

FIGS. 3 and 4 additionally show that the first side wall 17 and the second side wall 18 do not extend in parallel when viewed in a vertical direction, but rather diverge slightly, starting from the base 11. The same applies to the front wall 15 and rear wall 16. On account of the divergence of the walls 15, 16, 17, 18, the surface area of the base 11 is smaller than the surface area of the tub opening 14. It is also clear from FIGS. 3 and 4 that the base 11 is slightly profiled. The base in this case has the basic shape of a hipped roof, the apex 31 of which does not extend over the entire width of the front wall 15 or rear wall 16, but rather only over a central portion.

Figure 5:
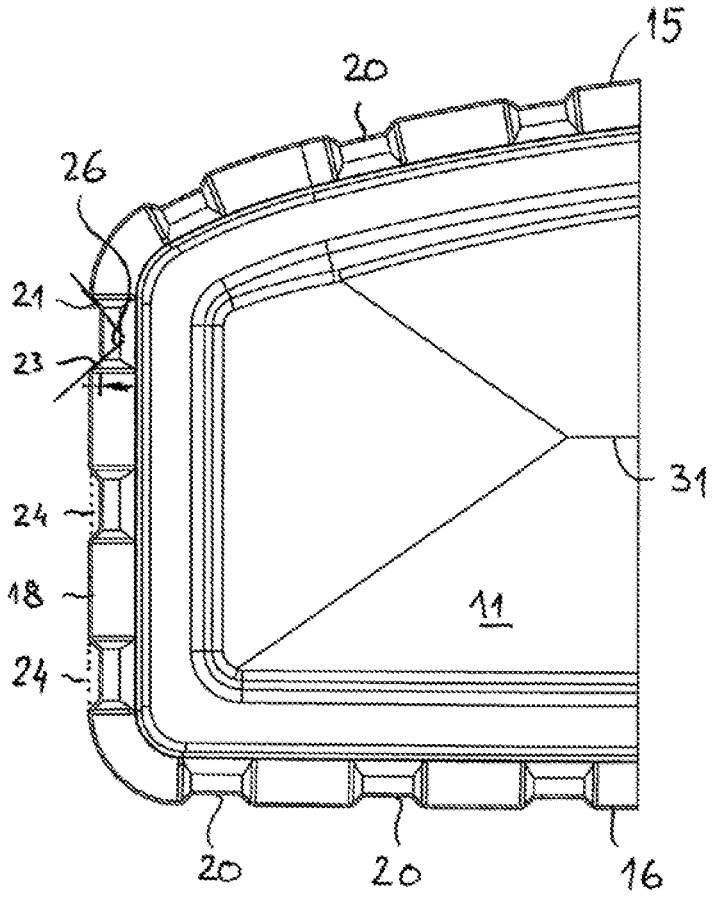
FIG. 5 is a partial section along the line V-V in FIG. 4.

FIG. 5 also shows the trapezoidal basic shape of the ridge 20. The angle 26 between the ridge slopes 21, 23, which are inclined relative to the datum plane 24, is in this case approximately 90°. Accordingly, each ridge slope 21, 23 has an angle of approximately 45° relative to the datum plane 24.

In order to label/advertise the dosing units located inside the tub 10, a circumferential sleeve can be placed around the tub wall. The sleeve is preferably made of paper or cardboard and may comprise a tear-off strip in order to allow easy removal of the sleeve if, after use of the container, the paper and plastics material are to be separated for the purposes of recycling.

On account of the relatively planar ridges 20, the height of which increases only very slightly with the distance from the base 11, the tub 10 can be produced in a cost-effective manner by means of a thermoforming process like a comparable tub that does not have surface-structured tub walls. The ridges 20 mean that the effective contact surface between dosing units 50 and the tub walls 12 is kept small. As a result, the dosing units, which potentially adhere to the tub walls due to a particular air humidity, can be easily removed from the tub 10.

LIST OF REFERENCE SIGNS

10 tub
11 base
12 tub wall
13 upper tub edge
14 tub opening
15 front wall
16 rear wall
17 first side wall
18 second side wall
19 tub interior
20 ridge (first ridge, additional ridges; ridge 20*a*)
21 first ridge slope
22 ridge summit
23 second ridge slope
24 datum plane
25 height of the ridge
26 angle
27 width of the ridge
28 width of the ridge summit
29 distance between two ridges
30 ledge
31 apex
50 dosing unit
51 wrapping
52 thermoform film
53 cover film
54 first pocket
55 second pocket

What is claimed is:

1. A container comprising a thermoformed tub made of a plastics material, said tub having a tub interior; at least one dosing unit having a length and a width arranged in said tub interior, wherein the dosing unit comprises at least one active ingredient enclosed in a water-soluble casing, the tub comprising a base and a tub wall that extends from the base, wherein the tub wall comprises a plurality of projections that are oriented from a datum plane of the tub wall towards the tub interior, the tub wall having a distance between adjacent projections wherein said distance is less than said length and less than said width of the dosing unit.

2. The container according to claim 1, wherein the distance between adjacent projections is less than half of the length and less than half of the width of the dosing unit.

3. The container according to claim 1, wherein the projections comprise a first ridge that extends in a longitudinal direction and additional ridges that are parallel to the first ridge.

4. The container according to claim 3, wherein a width of the first ridge is less than a distance between adjacent ridges.

5. The container according to claim 3, wherein the first ridge extends from the base towards an upper tub edge.

6. The container according to claim 5, wherein the first ridge extends substantially over the distance between the base and the upper tub edge.

7. The container according to claim 3, wherein the height of the first ridge varies in the longitudinal direction.

8. The container according to claim 3, wherein, in cross section, the first ridge has a first ridge slope, a ridge summit and a second ridge slope, the first ridge slope and the second ridge slope bridging a gap between the ridge summit and the datum plane of the tub wall.

9. The container according to claim 8, wherein the first ridge slope and the second ridge slope extend obliquely with respect to one another and form an angle of from 60 to 120°.

10. The container according to claim 6, wherein a surface area of the base is smaller than a surface area of a tub opening.

11. The container according to claim 6, wherein the dosing unit comprises at least one second active ingredient.

* * * * *